US008186261B2

(12) United States Patent
McNeill et al.

(10) Patent No.: US 8,186,261 B2
(45) Date of Patent: May 29, 2012

(54) ADJUSTABLE MUZZLE BRAKE

(76) Inventors: Robert McNeill, Chuluota, FL (US); Russell Kath, Lake Mary, FL (US)

( * ) Notice: Subject to any disclaimer, the term of this patent is extended or adjusted under 35 U.S.C. 154(b) by 216 days.

(21) Appl. No.: 12/762,318

(22) Filed: Apr. 17, 2010

(65) Prior Publication Data

US 2011/0252952 A1 Oct. 20, 2011

(51) Int. Cl.
*F41A 21/38* (2006.01)

(52) U.S. Cl. ..... 89/14.3; 89/14.5; 181/223; 42/79; 42/1.06

(58) Field of Classification Search ..... 89/14.1–14.5; 181/223; 42/1.06, 79, 97
See application file for complete search history.

(56) References Cited

U.S. PATENT DOCUMENTS

| | | | | | |
|---|---|---|---|---|---|
| 817,134 | A * | 4/1906 | Smith | 89/14.3 |
| 1,636,357 | A * | 7/1927 | Cutts, Jr. | 89/14.3 |
| 2,499,428 | A * | 3/1950 | Belle | 89/14.3 |
| 2,712,193 | A * | 7/1955 | Mathis | 42/79 |
| 3,187,633 | A * | 6/1965 | Tanabe | 89/14.3 |
| 4,726,280 | A * | 2/1988 | Frye | 89/16 |
| 4,833,808 | A * | 5/1989 | Strahan | 42/1.06 |
| 4,939,977 | A * | 7/1990 | Stroup | 89/14.4 |
| 5,020,416 | A * | 6/1991 | Tripp | 89/14.3 |
| 5,303,634 | A * | 4/1994 | Warner et al. | 89/14.2 |
| 5,305,677 | A * | 4/1994 | Kleinguenther et al. | 89/14.2 |
| 5,476,028 | A * | 12/1995 | Seberger | 89/14.3 |
| 5,631,438 | A * | 5/1997 | Martel | 89/14.3 |
| 5,698,810 | A * | 12/1997 | Rose | 89/14.3 |
| 6,346,114 | B1 * | 2/2002 | Schraga | 606/182 |
| 7,059,235 | B2 * | 6/2006 | Hanslick et al. | 89/14.3 |
| 7,143,680 | B2 * | 12/2006 | Bender | 89/14.3 |
| 7,588,122 | B2 * | 9/2009 | Brittingham | 181/223 |
| 7,676,980 | B2 * | 3/2010 | Bender | 42/97 |
| 7,677,150 | B2 * | 3/2010 | Dater et al. | 89/14.05 |

* cited by examiner

*Primary Examiner* — Michael David
(74) *Attorney, Agent, or Firm* — The Patent Guild; Paul Royal, Jr.

(57) ABSTRACT

An adjustable muzzle brake in which an interior volume of the muzzle chamber can be varied without the use of tools which allows shooters to adjust the flow of the propellant gases and thereby allow shooters to determine and select the optimum recoil for their shooting preference.

11 Claims, 6 Drawing Sheets

ADJUSTABLE MUZZLE BRAKE

FIELD OF THE INVENTION

The present invention relates to an adjustable muzzle brake.

BACKGROUND OF THE INVENTION

Generally muzzle brakes redirect propellant gases of firearms to lessen unwanted movement of the barrel during firing and to reduce or control the effect of the recoil. Muzzle brakes are also sometimes called compensators. Propellant gases exiting the firearm muzzle generate torque or force which causes the muzzle of the firearm to shift position depending on the dispersal orientation of the gases exiting the muzzle. Most often the muzzle will rise upwards or even rotate along the centerline of the barrel.

Adjustable muzzle brakes allow shooters to adjust the orientation of the venting of the propellant gases and thereby allow shooters to determine and select the optimum recoil for their shooting preference. Professional marksmen and competition shooters most often need to make adjustments to the firearm recoil via the muzzle brake to find a compromise between the force of the escaping propellant gases and a comfortable shooting position. While adjustable muzzle brakes are generally known, to adjust these devices hand tools and support apparatus is often required. Once a shooter has selected an optimum shooting position, locating and using a supplemental hand tool to adjust the muzzle brake usually shifts the shooter out of position.

What is needed is an adjustable muzzle brake which can be operated with or without the use of supplemental hand tools so that shooters can maintain the selected body position while adjusting the dispersal orientation of the gases exiting the firearm muzzle and the resultant recoil.

Known patents of interest include: U.S. Pat. No. 817,134—a recoil-neutralizing attachment, U.S. Pat. No. 1,636,357—an anticlimb device, U.S. Pat. No. 2,206,588—a recoil control device, U.S. Pat. No. 2,499,428—a muzzle brake, U.S. Pat. No. 2,712,193—a shotgun choking mechanism, U.S. Pat. No. 3,187,633—a muzzle brake for firearms, U.S. Pat. No. 4,726,280—a muzzle member, U.S. Pat. No. 4,833,808—an anti-recoil device, U.S. Pat. No. 4,939,977—a silencer, U.S. Pat. No. 5,020,416—a muzzle brake for firearms including a housing positioned at the end of a gun barrel which defines a gas receiving expansion chamber, U.S. Pat. No. 5,303,634—a flash compressor, U.S. Pat. No. 5,305,677—a muzzle brake-bullet stabilizer, U.S. Pat. No. 5,476,028—a gun muzzle brake, U.S. Pat. No. 5,631,438—a gas pressure deflector system mounted on the exterior of a muzzle brake for a firearm barrel, U.S. Pat. No. 5,698,810—a convertible ballistic optimizing system, U.S. Pat. No. 6,346,114—an adjustable length member, U.S. Pat. No. 7,059,235—a muzzle stabilizer for a repeating firearm, U.S. Pat. No. 7,143,680—a recoil and muzzle blast dissipater, U.S. Pat. No. 7,588,122—an orientation apparatus, U.S. Pat. No. 7,676,980—an adjustable mass tuner for rifle barrels , U.S. Pat. No. 7,677,150—a mounting system for muzzle devices and firearms, and U.S. RE. 35,381—a ballistic optimizing system for use on a preferably bedded rifle.

SUMMARY OF THE INVENTION

The adjustable muzzle brake provided herein as the instant invention is an innovative muzzle brake that allows discharge gas volume and energy from the firing of a weapon to be selectively diverted as it exits the barrel of the weapon without the use of tools.

BRIEF DESCRIPTION OF THE DRAWINGS

The invention is explained below in view of the drawings.

DETAILED DESCRIPTION OF THE INVENTION

Figure 1A:
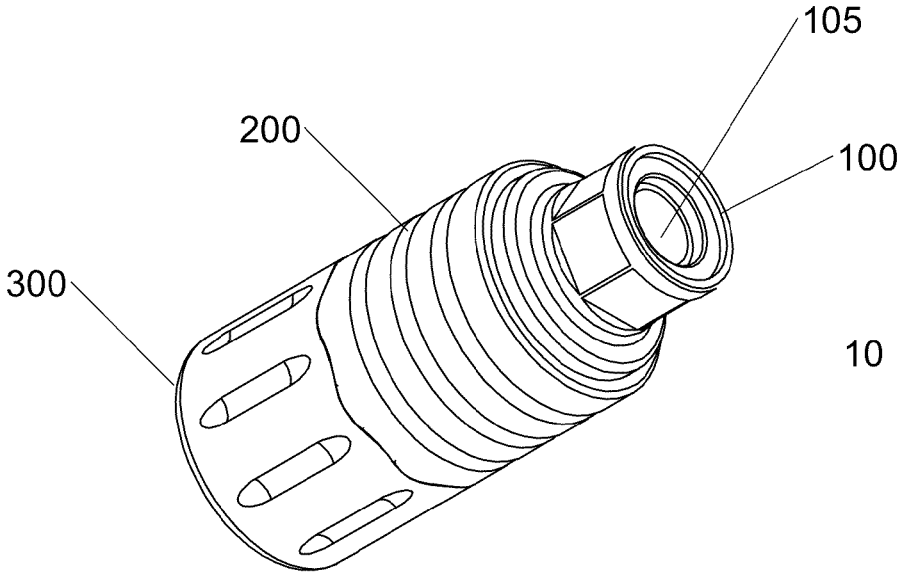
FIG. 1A illustrates a perspective view of the adjustable muzzle brake.
Figure 1B:
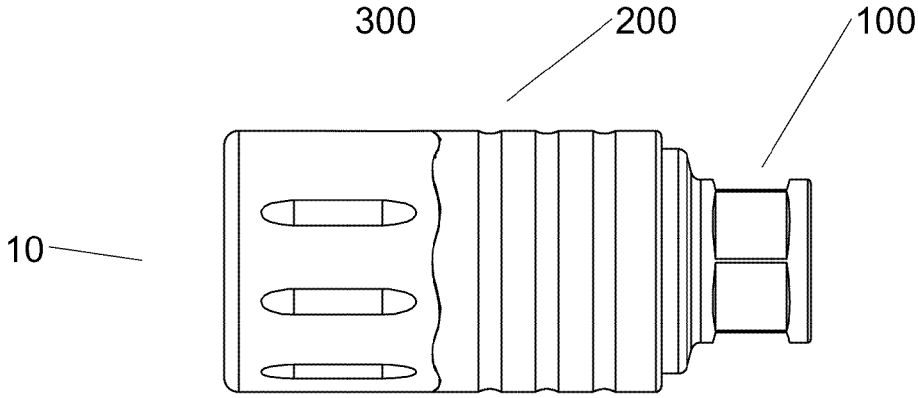
FIG. 1B illustrates a side view of the adjustable muzzle brake.

The preferred embodiment, as shown in FIGS. 1A-10, of the adjustable muzzle brake (10) consists generally of a body (100), a locking ring (200), a cap (300), a cone (400), a rear ring (500), a front ring (600), and a spring (700).

Adjustment of the muzzle brake allows discharge gasses and energy from the firing of a weapon to be selectively diverted as the discharge gases exit the barrel of the weapon. By selecting the appropriate volume of gas to divert, users can determine an optimum setting which enhances the accuracy of the weapon. Users can operate the adjustable muzzle brake in modes ranging from fully closed, wherein minimal discharge gas volume is diverted, to fully open wherein a maximum amount of discharge gas volume is diverted. Adjustment of the instant invention allows selective adjustment of the volume of discharge gas which is diverted by the muzzle brake.

The present invention is particularly advantageous because no tools are needed to adjust the volume of discharge gas which is diverted by the muzzle brake. Note—the term "upstream" refers to a location nearer to the weapon barrel than a "downstream" location.

The body (100) generally includes a first section (120) integrally connected to a second section (140) which is integrally connected to a third section (160). The muzzle brake body (100) includes a bore (105) extending concurrently through the center of the first, second, and third body sections (120, 140, 160). The bore (105) further includes a bore wall (106) which is shaped to include a change in bore diameter (107).

The body first section (120) includes attachment surfaces (110) on its external periphery. These attachment surfaces (110) are generally flat or of a tool conforming shape which allows the use of tools, such as a wrench, to help secure the adjustable muzzle brake to the barrel of a weapon (not shown).

The periphery of the body second section (140) includes a body ring channel (141) and a retaining ridge (145).

The periphery of the body third section (160) includes threads (161) and at least one positioning channel (162). The at least one positioning channel (162) extends in the direction parallel to the bore (105).

The cap (300) includes a first end (310), a second end (380), and a cap bore (350) extending internally through the cap from the first end (310) to the second end (380). The cap periphery includes cap gripping means (301) for assisting users with grasping the cap (300). The cap gripping means includes, inter alia, protrusions extending from the cap periphery, indentures extending into the cap periphery, and gripping attachments—such as tape and material deposits. The cap gripping means (301) assist users with grasping the cap (300) by, for example, providing a patterned area of protrusions on the cap periphery or depression rings indented into the cap periphery.

The cap bore (350) includes a cap ring channel (351) at the cap first end (310). The cap first end bore further includes a recess (352) positioned upstream from the cap ring channel (351).

The cap further includes threads (353) provided on the bore at the second end (380). The threads (353) are positioned upstream from the recess (352) and coil in the direction of the cap first end (310) along an axis parallel to the cap bore (350).

The edge of the cap second end (380) includes shaped surfaces (381). The shaped surfaces can include sine wave patterns, saw-tooth patterns, or flat edges, as well as other shapes.

The cone (400) includes a first section (420) integrally connected to a second section (440) which is integrally connected to a third section (460). The cone (400) includes a bore (405) extending concurrently through the center of the first, second and third cone sections (420, 440, and 460). The cone bore (405) is generally cylindrical (406) at the cone first section (420), generally conical (407) at the cone second section (440) and generally cylindrical (408) at the cone third section (460).

As needed, the area forming the cone bore first section (420) may be thickened to reduce flame induced corrosion and distortion thereby greatly increasing the life of the adjustable muzzle brake (10).

The cone third section (460) includes a cone ring channel (461) on its outer periphery.

The cone (400) is attached to the cap (300) by simultaneously seating the front ring (600) partially into the cone ring channel (461) and partially into the cap ring channel (351) thereby forming a cap/cone combination (800).

The front ring (600) may be of any suitable ring design such as a snap ring. Attaching the cone (400) to the cap (300) in the manner prescribed above allows for consistent and repeatable adjustment of the muzzle brake (10) at any firing angle because the cone (400) is in a fixed position with respect to the cap (300).

The locking ring (200) includes a first section (220) integrally connected to a second section (240) which is integrally connected to a third section (260). The locking ring (200) includes a bore (205) extending concurrently through the center of the first, second and third locking ring sections (220, 240, and 260).

The locking ring third section (260) further includes extension sections (261) extending into the bore (205) region.

The locking ring third section (260) includes shaped surfaces (281) at the edge (282) of the third section. The shaped surfaces (281) can comprise sine wave patterns, saw-tooth patterns, or flat edges, as well as other shapes and any combination thereof.

Figures 2, 4:
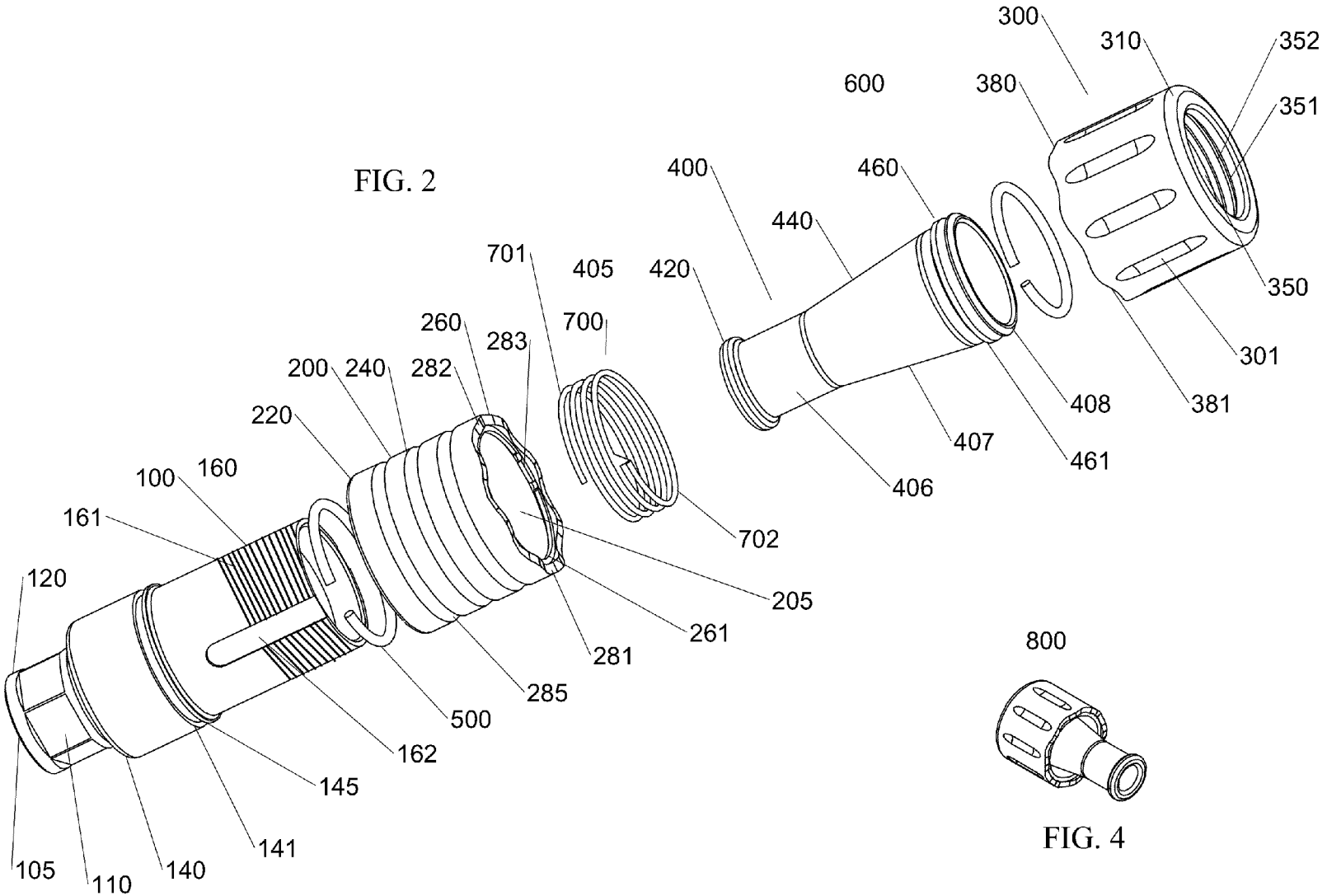
FIG. 2 illustrates an exploded view of the adjustable muzzle brake.
FIG. 4 illustrates a perspective view of the cap/cone combination.

As shown in FIG. 2, the locking ring third section (260) further includes at least one positioning tab (283) adjacent the locking ring edge (282).

The locking ring (200) is mounted onto the body (100), the positioning tab(s) (283) are seated within at least one body positioning channel (162) provided on the body (100) to prevent rotation of the locking ring (200).

Further, its easier to unscrew the cap (300) when the locking ring (200) is held in place because the lock ring positioning tab(s) (283) and the body positioning channel(s) (162) operate together to prevent the locking ring (200) from twisting while allowing the cap (300) to freely rotate as the cap (300) is twisted to follow the path of the body threads (161).

The locking ring third section shaped surfaces (281) are selected to be complimentary to the cap second end's shaped surfaces (381).

The locking ring periphery includes locking ring gripping means (285) for assisting users with grasping the locking ring (200) The locking ring gripping means (285) includes, inter alia, protrusions extending from the locking ring periphery, indentures extending into the locking ring periphery, and gripping attachments—such as tape and material deposits. The locking ring gripping means (285) assist users with grasping the locking ring (200) by, for example, providing a patterned area of protrusions on the locking ring periphery or depression rings indented into the locking ring periphery.

When the adjustable muzzle brake (10) is fully assembled, the locking ring (200) is positioned around the body (100) at the body second section (140).

Spring (700) is positioned between the periphery of the body's second section (140) and the locking ring bore (205). Spring (700) includes a first turn (701), a last turn (702) and is generally coiled about an axis extending parallel to the locking ring bore (205). The spring is positioned onto the body (100) such that the first turn (701) abuts (or nearly abuts) the body retaining ridge (145) and the spring final turn (702) abuts (or nearly abuts) the locking ring extension sections (261). The spring (700) is generally an uncompressed spring. Further when the spring (700) is compressed it reacts by applying a resistive force against the compressive force.

The locking ring (200) is secured to the body (100) when the rear ring (500) is seated partially into the body ring channel (141) and partially within the lock ring bore (205). When mounted to the body, the locking ring (200) can translate in the direction parallel to locking ring bore (205) in coordination with the spring (700). The translation length is limited by the locking ring end wall (221), the locking ring extension sections (261), and, if present, the spring resistive force which is generated against a compressive force applied to the spring (700).

When the adjustable muzzle brake (10) is fully assembled, the cone/cap combination (800) is positioned within the bore (107) of the body (100) and the locking ring (200) adjustably secures the body (100) to the cone/cap combination (800).

With the cone (400) seated in the bore (107) of the body (100), a controlled volume (900) is formed which is bounded by the body bore diameter (107) and the outer periphery of the cone (400). The cone (400) is seated within the body (100) such that the cone first section (420) nearly abuts the body bore wall (106). The distance between the cone first section (420) and the body bore wall (106) provides a key dimension in determining the volume encompassed by the controlled volume (900).

The clearance between the cone first section (420) and the body bore wall (106) provides a path for discharge gasses (901) exiting the weapon muzzle (not shown) to enter the controlled volume (900). By adjustment of the controlled volume (900) as taught herein, the amount of discharge gas (901) which enters the adjustable muzzle brake of the instant invention can be varied by twisting the cap (300) to follow the path of the body threads (161).

The locking ring (200) is pulled downwards or towards the body first section (420) to allow the cap (300) to be screwed or twisted in either direction. Moving the locking ring (200) towards the body first section (420) creates compressive forces on the spring (700) when the spring (700) is positioned to abut the locking ring extensions (261) and the body retaining ridge (145). When the locking ring (200) is released the locking ring shaped surfaces (281) are forced against the cap shaped surfaces (381) by the release of the compressed force of the spring (700) thereby holding the cone (400) and body bore (107) in a fixed relationship.

The lock ring positioning tab(s) (283) translate within the body positioning channels (162) as the locking ring (200) moves towards or away from the body first section (420).

When the cap threads (353) and body threads (161) are in initial contact [such as during initial assembly of the adjustable muzzle brake (10)] the distance between the cone first section (420), the body bore wall (106) is at its maximum, and the size of the controlled volume (900) is at its maximum.

To change the volume of the controlled volume (900), the locking ring (200) is pulled downwards or towards the cone first section (420). This frees the locking ring shaped surfaces (281) from being pressed against the cap shaped surfaces (381) and the cone/cap combination (800) can be adjusted as needed to either increase the controlled volume (900) or to decrease the controlled volume (900) by twisting the cap (300) to follow the path of the body threads (161).

The lock ring positioning tab(s) (283) and the body positioning channels (162) operate together to prevent the locking ring (200) from twisting while allowing the cap (300) to freely rotate in coordination with the cap treads (353) and the body thread (161) when the locking ring shaped surfaces (281) and the cap shaped surfaces (381) are not in interfacing contact with each other.

When the locking ring shaped surfaces (281) and the cap shaped surfaces (381) are in interfacing contact with each other the interfacing surfaces are shaped such that the cap/cone combination (800) can be twisted or turned in coordination with the cap treads (353) and the body thread (161). For example, the sine-waved or saw-toothed of the ring shaped surfaces (281) and the cap shaped surfaces (381) are angled so that the surface slip against each other when a suitable twisting force is applied to the cap (300). Other shapes for the locking ring shaped surfaces (281) and the cap shaped surfaces (381) can be selected which do or do not provide surface slip.

Figure 3:
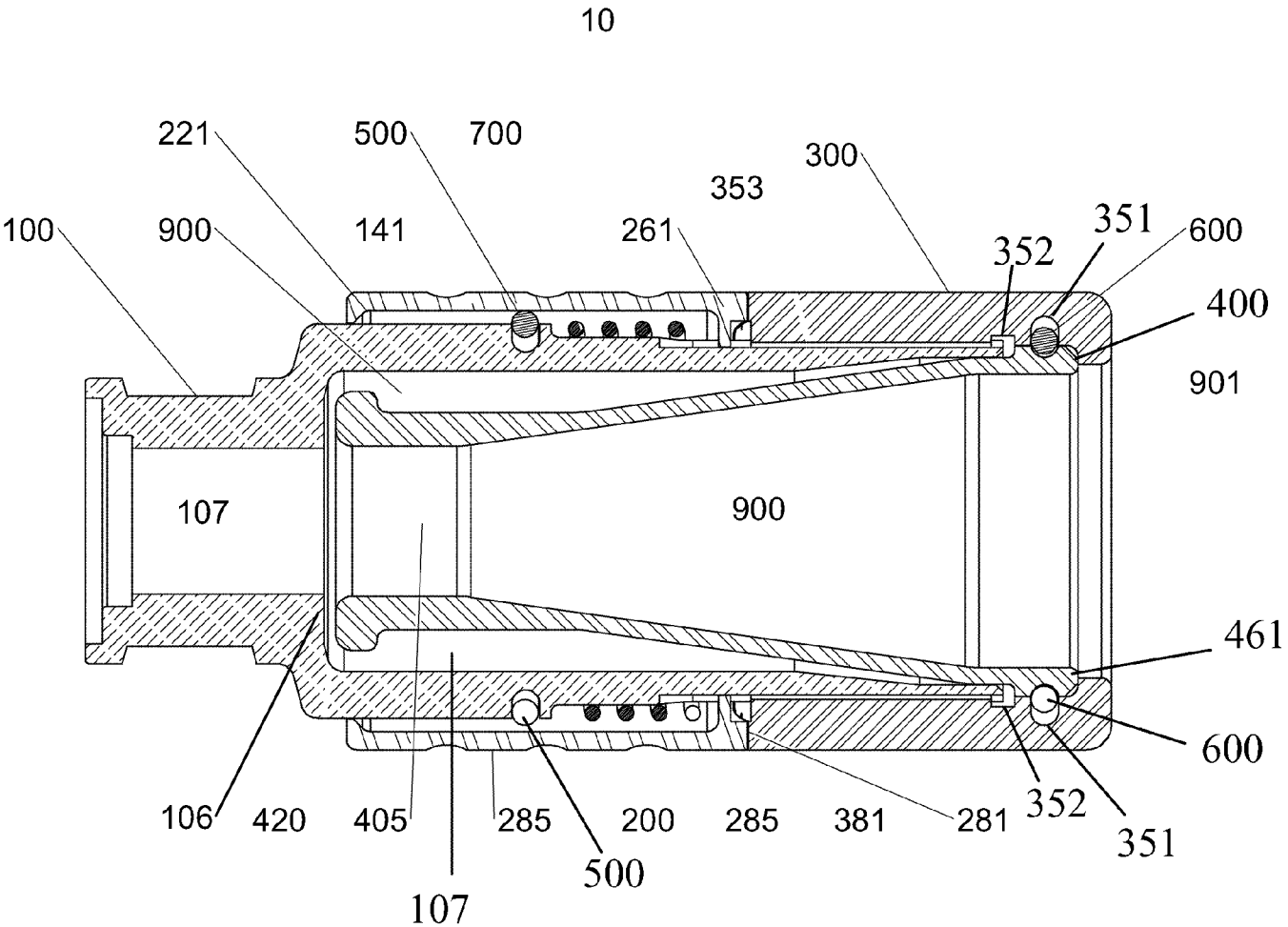
FIG. 3 illustrates a side cross section view of the adjustable muzzle brake.
Figure 5:
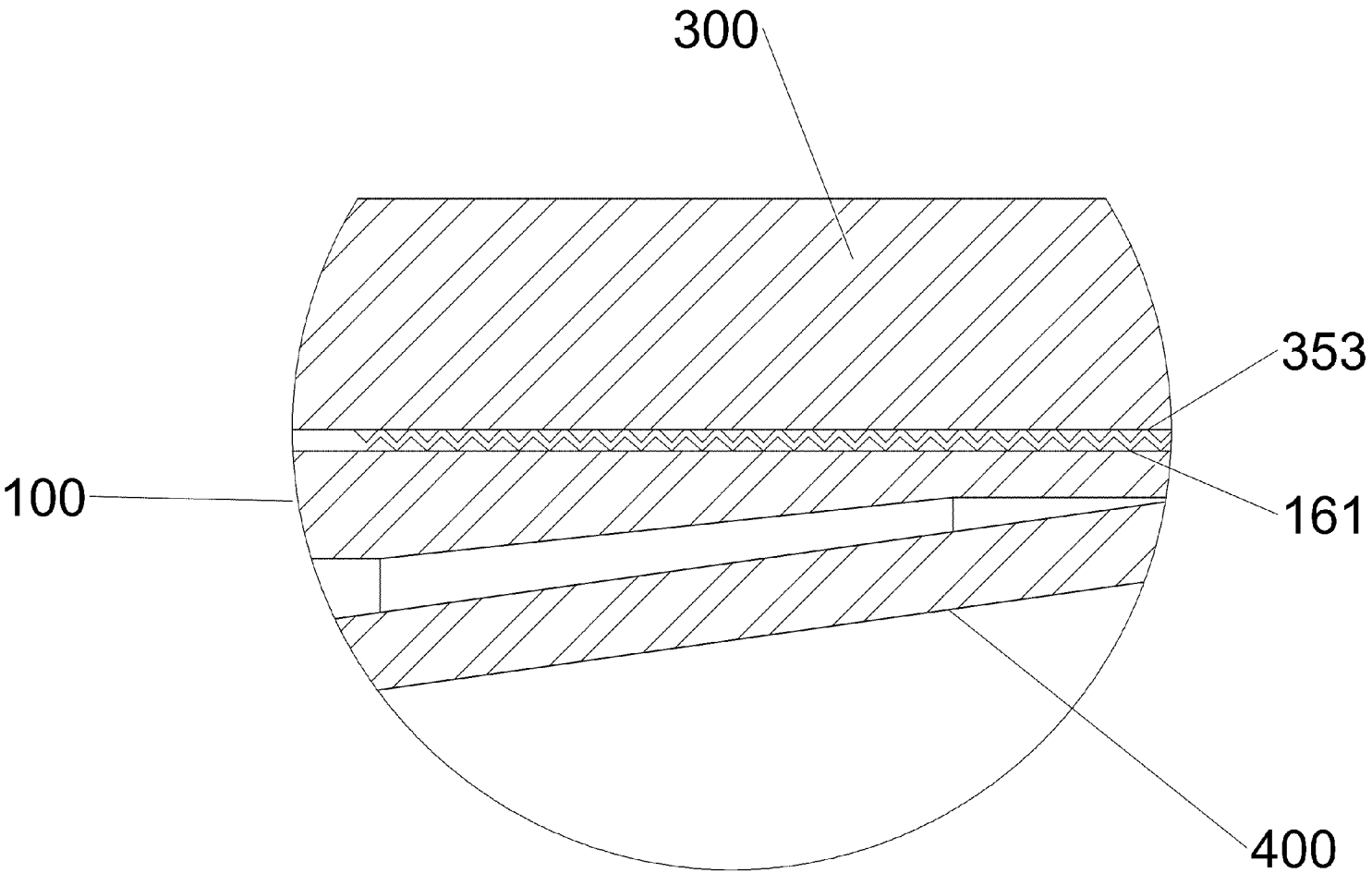
FIG. 5 illustrates a sectioned view of FIG. 3.
Figure 7:
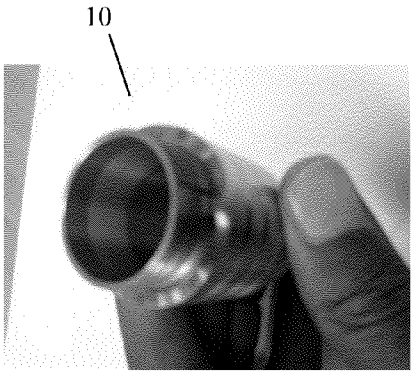
FIG. 7 is a photo perspective view of the adjustable muzzle brake.
Figure 6:
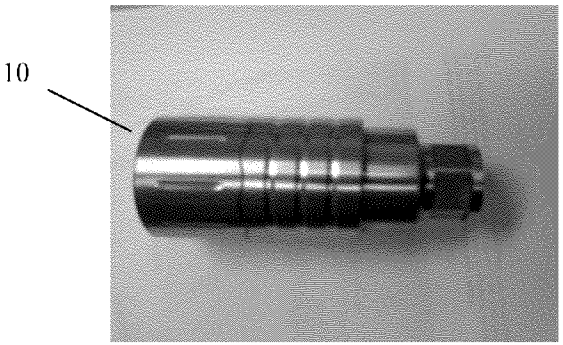
FIG. 6 is a photo side view of the adjustable muzzle brake.
Figure 8:
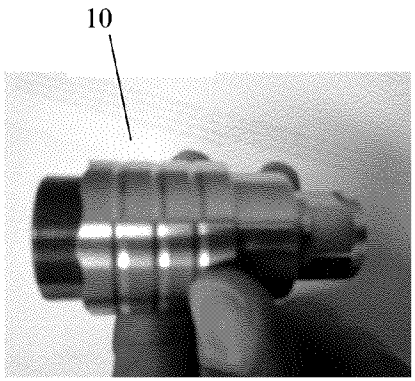
FIG. 8 is a photo side view of the adjustable muzzle brake without the cap/cone combination.
Figure 10:
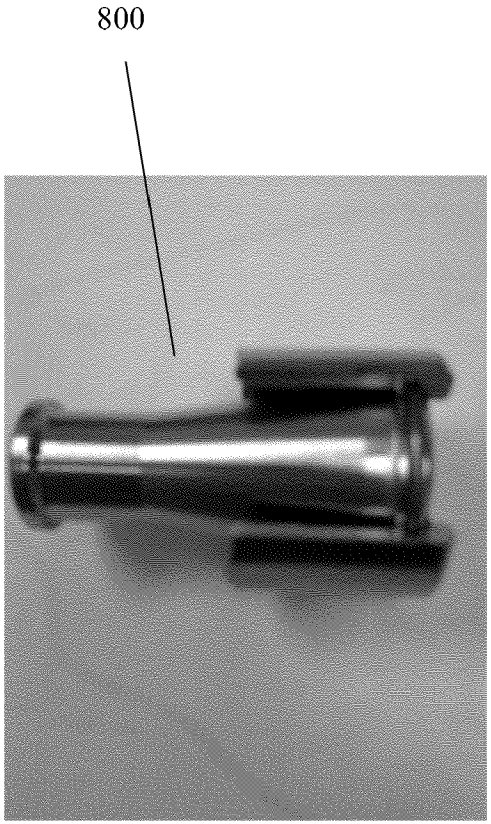
FIG. 10 is a photo side view of the cross-section of the cap/cone combination.
Figure 9:
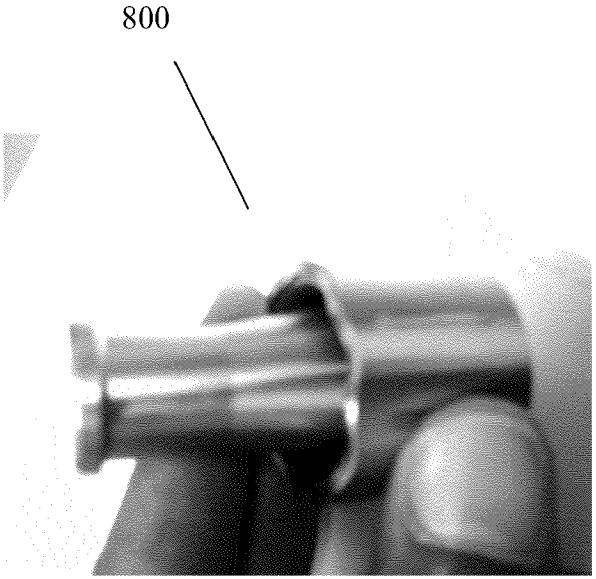
FIG. 9 is a photo side view of the cap/cone combination.

As shown in FIG. 5, the body threads (161) of the body (100) interface with the cap threads (353) of the cap (300) thereby translating the cone (400) which is connected to the cap (300) as part of the cap/cone combination (800) as seen in FIG. 3 and FIG. 4.

As the cap (300) is screwed further onto (or off) the body threads (161), the locking ring (200) can be translated along the at least one positioning channel (162) thereby allowing the depth of the penetration of the cone/cap combination (800) into the body bore (107) area to be adjusted. Reducing the distance between the cone first section (420) and the body bore wall (106) reduces the volume of the controlled volume (900) and increasing the distance between the cone first section (420) and the body bore wall (106) increases the volume of the controlled volume (900).

As previously explained, the clearance between the cone first section (420) and the body bore wall (106) also form the path for discharge gasses (901) which are exiting the weapon muzzle (not shown). By adjusting the controlled volume (900) as taught herein, the amount of discharge gas (901) which enters the adjustable muzzle brake (10) of the instant invention is varied which correspondingly affects the muzzle force dispersal pattern.

Operation of the Muzzle Brake

The controlled volume (900) can be variably reduced or increased as desired by sliding the locking ring (200) down and twisting the cap/cone combination (800) in the selected direction.

By adjusting the controlled volume (900) users can calibrate their weapons to a desired muzzle force dispersal pattern by firing several rounds and adjusting the adjustable muzzle brake until the optimum muzzle force dispersal pattern is determined.

While various embodiments of the present invention have been shown and described herein, it will be obvious that such embodiments are provided by way of example only. Numerous variations, changes and substitutions may be made without departing from the invention herein.

It is intended that the present invention be made of presently known material suitable and appropriate for firearms and firearm components.

Accordingly, it is intended that the invention be limited only by the spirit and scope of the appended claims.

What is claimed is:

1. An adjustable muzzle brake comprising:

a body (100);

a cap (300);

a cone (400);

a front ring (600); and translating locking means for interconnecting the body (100), cap (300), and cone (400);

wherein the cone (400) is attached to the cap (300) by simultaneously seating the front ring (600) partially into a cone ring channel (461) of the cone (400) and partially into a cap ring channel (351) of the cap (300) thereby forming a cap/cone combination (800) and the cap/cone combination (800) is positioned within a bore (107) of the body (100); and wherein the translating locking means are mounted onto the body (100) to adjustably and releasably secure the body (100) to the cap/cone combination (800) wherein adjustment of the cap/cone combination (800) adjusts a controlled volume (900) bounded by a diameter of the body bore (107) and an outer periphery of the cone (400).

2. The adjustable muzzle brake of claim 1 wherein the translating locking means includes at least one locking ring positioning tab (283) provided on a locking ring (200);

wherein the at least one locking ring positioning tab (283) is seated within at least one body positioning channel (162) provided on the body (100) to prevent rotation of the translating locking means; and wherein the at least one body positioning channel (162) allows the locking ring (200) to translate in a direction parallel to a locking ring bore (205) of the locking ring (200) in coordination with a spring (700) positioned between the body (100) and the locking ring bore (205).

3. The adjustable muzzle brake of claim 1 wherein the translating locking means includes a locking ring (200) having a first section (220) integrally connected to a second section (240) which is integrally connected to a third section (260), and a bore (205) extending concurrently through the center of the first, second and third locking ring sections (220, 240, and 260), wherein the locking ring third section (260) further includes extension sections (261) extending into the bore (205).

4. The adjustable muzzle brake of claim 3 further including at least one locking ring positioning tab (283) provided on the locking ring (200);

wherein the at least one locking ring positioning tab (283) is seated within at least one body positioning channel (162) provided on the body (100) to prevent rotation of the locking ring (200); and wherein at least one body positioning channel (162) allows the locking ring (200) to translate in a direction parallel to the locking ring bore (205) in coordination with a spring (700) positioned between the body (100) and the locking ring bore (205).

5. The adjustable muzzle brake of claim 4 further including a rear ring (500) seated partially in a body ring channel (141) of the body (100) and partially within the locking ring bore (205) of the locking ring (200).

6. The adjustable muzzle brake of claim 1 further including a rear ring (500) seated partially in a body ring channel (141) of the body (100) and partially within a locking ring bore (205) of a locking ring (200) provided in the translating locking means.

7. The adjustable muzzle brake of claim 1 further including a spring (700) positioned between the body (100) and a locking ring bore (205).

8. The adjustable muzzle brake of claim 1 further including:

a rear ring (500) seated partially in a body ring channel (141) of the body (100) and partially within a locking ring bore (205) of a locking ring (200) provided in the translating locking means; and a spring (700) positioned between the body (100) and the locking ring bore (205).

9. An adjustable muzzle brake comprising:

a body (100);

a locking ring (200);

a cap (300);

a cone (400);

a rear ring (500);

a front ring (600);

a spring (700);

wherein the cone (400) is attached to the cap (300) by simultaneously seating the front ring (600) partially into a cone ring channel (461) of the cone (400) and partially into a cap ring channel (351) of the cap (300) thereby forming a cap/cone combination (800);

the rear ring (500) is seated partially into a body ring channel (141) of the body (100) and partially within a locking ring bore (205) of the locking ring (200);

wherein the locking ring (200) is mounted onto the body (100) and at least one locking ring positioning tab (283) provided on a locking ring (200) is seated within respective body positioning channels (162) provided on the body (100) to prevent rotation of the locking ring (200);

wherein body positioning channels (162) allow the locking ring (200) to translate in a direction parallel to the locking ring bore (205) of the locking ring (200) in coordination with the spring (700) which is positioned between the body (100) and the locking ring bore (205); and wherein when the adjustable muzzle brake (100) is fully assembled, the cap/cone combination (800) is positioned within a bore (107) of the body (100) and the locking ring (200) adjustably secures the body (100) to the cap/cone combination (800).

10. The adjustable muzzle brake of claim 9 wherein adjustment of the cap/cone combination (800) adjusts a controlled volume (900) bounded by a diameter of the body bore (107) and an outer periphery of the cone (400).

11. An adjustable muzzle brake comprising:

a body (100);

a locking ring (200);

a cap (300);

a cone (400);

a rear ring (500);

a front ring (600);

a spring (700);

wherein the body (100) generally includes a first section (120) integrally connected to a second section (140) which is integrally connected to a third section (160), the muzzle brake body (100) includes a bore (105) extending concurrently through the center of the first, second, and third body sections (120, 140, 160);

the cap (300) includes a first end (310), a second end (380), and a cap bore (350) extending internally through the cap (300) from the first end (310) to the second end (380);

the cone (400) includes a first section (420) integrally connected to a second section (440) which is integrally connected to a third section (460), the cone (400) includes a bore (405) extending concurrently through the center of the first, second and third cone sections (420, 440, and 460);

wherein the cone (400) is attached to the cap (300) by simultaneously seating the front ring (600) partially into a cone ring channel (461) of the cone (400) and partially into a cap ring channel (351) of the cap (300) thereby forming a cap/cone combination (800);

the locking ring (200) includes a first section (220) integrally connected to a second section (240) which is integrally connected to a third section (260), the locking ring (200) includes a bore (205) extending concurrently through the center of the first, second and third locking ring sections (220, 240, and 260), the locking ring third section (260) further includes extension sections (261) extending into the bore (205);

wherein the locking ring (200) is mounted onto the body (100) and at least one locking ring positioning tab (283) is provided on the locking ring (200);

wherein the at least one locking ring positioning tab (283) is seated within at least one body positioning channel (162) provided on the body (100) to prevent rotation of the locking ring (200);

wherein the locking ring (200) can translate in the direction parallel to the locking ring bore (205) in coordination with the spring (700) which is positioned between the body (100) and the locking ring bore (205);

wherein when the adjustable muzzle brake (10) is fully assembled, the cap/cone combination (800) is positioned within the bore (107) of the body (100) and the locking ring (200) adjustably secures the body (100) to the cap/cone combination (800); and wherein adjustment of the cap/cone combination (800) adjusts a controlled volume (900) bounded by a diameter of the body bore (107) and an outer periphery of the cone (400).

* * * * *